US012090361B2

(12) United States Patent
Reynolds

(10) Patent No.: US 12,090,361 B2
(45) Date of Patent: Sep. 17, 2024

(54) EXERCISE BENCH WITH ADJUSTABLE BACKREST

(71) Applicant: Cap Barbell, Inc., Houston, TX (US)

(72) Inventor: Curt Reynolds, Tomball, TX (US)

(73) Assignee: CAP BARBELL, INC., Houston, TX (US)

( * ) Notice: Subject to any disclaimer, the term of this patent is extended or adjusted under 35 U.S.C. 154(b) by 0 days.

(21) Appl. No.: 18/614,269

(22) Filed: Mar. 22, 2024

(65) Prior Publication Data

US 2024/0226644 A1 Jul. 11, 2024

Related U.S. Application Data

(63) Continuation-in-part of application No. 18/066,921, filed on Dec. 15, 2022, now Pat. No. 11,938,368.

(51) Int. Cl.
*A63B 21/00* (2006.01)

(52) U.S. Cl.
CPC .... *A63B 21/4029* (2015.10); *A63B 2225/093* (2013.01)

(58) Field of Classification Search
CPC ..... A63B 21/4029; A63B 2225/093; A63B 2225/09
See application file for complete search history.

(56) References Cited

U.S. PATENT DOCUMENTS 6,152,866 A * 11/2000 Kuo ..... A63B 21/055 482/130
7,044,898 B2 5/2006 Kuo et al.
D541,893 S 5/2007 Webber
7,674,215 B1 3/2010 Swanson et al.
8,206,272 B2 6/2012 Greene
8,968,162 B2 3/2015 Jaguan
11,925,829 B1 * 3/2024 Gonzalez ..... A63B 21/4029
11,938,368 B1 * 3/2024 Reynolds ..... A63B 21/4029
2001/0018387 A1 8/2001 Webber
2007/0129225 A1 * 6/2007 Hammer ..... A63B 23/0211 482/121
2007/0149373 A1 * 6/2007 Dalebout ..... A63B 23/1209 482/142
2011/0195822 A1 8/2011 Donofrio
2016/0089558 A1 3/2016 Noyes et al.
2016/0213968 A1 7/2016 Boss
2017/0216656 A1 8/2017 Leipheimer
2018/0099176 A1 4/2018 Specht et al.
2018/0369633 A1 12/2018 Baker et al.
2019/0151699 A1 5/2019 Isom
2020/0360764 A1 11/2020 Smith et al.
2023/0337829 A1 * 10/2023 Raiszadeh ..... A47C 9/005

* cited by examiner

*Primary Examiner* — Loan B Jimenez
*Assistant Examiner* — Andrew M Kobylarz
(74) *Attorney, Agent, or Firm* — D'Ambrosio & Menon, PLLC; Usha Menon

(57) ABSTRACT

A backrest assembly for an exercise bench includes a mounting bar, a first carriage member, a headrest, and a backrest. The first carriage member is configured for slidable insertion within a hollow cavity in the mounting bar. A back surface of the headrest is coupled to the first carriage member. The backrest segment is configured for upward and downward movement along the mounting bar. In one embodiment, the backrest assembly has at least two segments, such as an adjustable first backrest segment, and an adjustable second backrest segment.

13 Claims, 6 Drawing Sheets

EXERCISE BENCH WITH ADJUSTABLE BACKREST

CROSS REFERENCE TO RELATED APPLICATION

This application is a continuation-in-part of U.S. Ser. No. 18/066,921 filed on Dec. 15, 2022, the entire contents and disclosures of which, both express and implied, are incorporated herein by reference.

FIELD OF THE INVENTION

The present invention relates generally to exercise equipment. In particular, it pertains to an exercise bench having an adjustable backrest, and more particularly, to a height-adjustable backrest.

BACKGROUND

The background description includes information that may be useful in understanding the present invention. It is not an admission that any of the information provided herein is prior art or relevant to the presently claimed invention, or that any publication specifically or implicitly referenced is prior art.

An exercise bench, also known as a utility bench or a fitness bench, is an accessory that is typically used by those engaged in strength training. A user can engage in various exercises, such as, exercises using dumbbells, kettlebells or barbells, bench presses, and core work, while sitting or lying down on the exercise bench. The exercise bench facilitates proper posture so that the user can perform a workout correctly and, as such, is a very helpful piece of exercise equipment.

Conventional exercise benches can be flat or adjustable benches. Flat benches have a single cushion and do not have an adjustable back or seat. However, adjustable benches have an adjustable back and/or seat. The back and/or seat can be inclined or declined based on the user's requirements.

However, conventional adjustable exercise benches are manufactured according to standard specifications and are not configured to accommodate users of different heights. If the height of a user does not conform to a standard adjustable exercise bench, the user will have to contort themselves to try and fit their back and head on the backrest all the while trying to maintain safe and proper form during use. Therefore, while such users may still be able to use conventional adjustable exercise benches, it is not optimal from a safety or a proper form standpoint. Therefore, there is a need for an exercise bench that can be adjusted to accommodate users of varying heights.

SUMMARY

An improved exercise apparatus is provided to solve the above-described limitations of conventional exercise benches presently known in the art.

According to an embodiment, a backrest assembly for an exercise bench can include a mounting bar, a first carriage member where at least one end of the first carriage member can be dimensioned for slidable insertion within a hollow cavity in the mounting bar, a headrest where a back surface of the headrest can be coupled to the first carriage member and a backrest configured for upward and downward movement along the mounting bar. As used herein, an exercise bench includes any weight bench (including, but not limited to, a flat bench, adjustable (utility bench) or other training benches (such as, weightlifting benches/barbell bench, used with a barbell rack).

The headrest of the backrest assembly can be configured for upward and downward movement as the first carriage member is correspondingly retracted from and inserted within the hollow cavity in the mounting bar. The mounting bar can be secured to the first carriage member with a first connector.

The backrest assembly further comprises a second carriage member where a back surface of the backrest can be coupled to the second carriage member. The mounting bar can be securely mounted in a central opening in the second carriage member.

The headrest and backrest of the backrest assembly can be padded. In an embodiment, the backrest can include one or more segments or pieces. In another embodiment, the backrest can include two or more segments.

In one embodiment, the back surface of a first backrest segment can be coupled to the second carriage member and the back surface of a second backrest segment can be coupled to a third carriage member. The mounting bar of the backrest assembly is securely mounted in a central opening in the second carriage member and the third carriage member. The mounting bar can be secured to the second and third carriage members with a second and third connector respectively. The first and/or second backrest segment is configured for upward and downward movement along the mounting bar.

The mounting bar of the backrest assembly can be coupled to a basal frame. The basal frame can include a seat/padded seat.

In another embodiment, a backrest assembly for an exercise bench can include a mounting bar, a headrest where a back surface of the headrest can be coupled to a first carriage member and a backrest configured for upward and downward movement along the mounting bar. The backrest can include two or more segments.

The mounting bar of the backrest assembly can be secured to the first carriage member with a first connector.

The backrest assembly further comprises a second carriage member where a back surface of a second backrest segment can be coupled to the second carriage member and a third carriage member where a back surface of a third backrest segment is coupled to the third carriage member. Also, the headrest and the backrest of the backrest assembly can be padded.

Various objects, features, aspects, and advantages of the inventive subject matter will become more apparent from the following detailed description of preferred embodiments and the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the present disclosure as defined by the appended claims.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases, it will be recognized that references to the "invention" will refer to subject matter recited in one or more, but not necessarily all, of the claims. As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples or exemplary language (for example, "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Various terms are used herein. To the extent a term used in a claim is not defined, it should be given the broadest definition persons in the pertinent art have given that term as reflected in printed publications and issued patents at the time of filing.

Figure 1A:
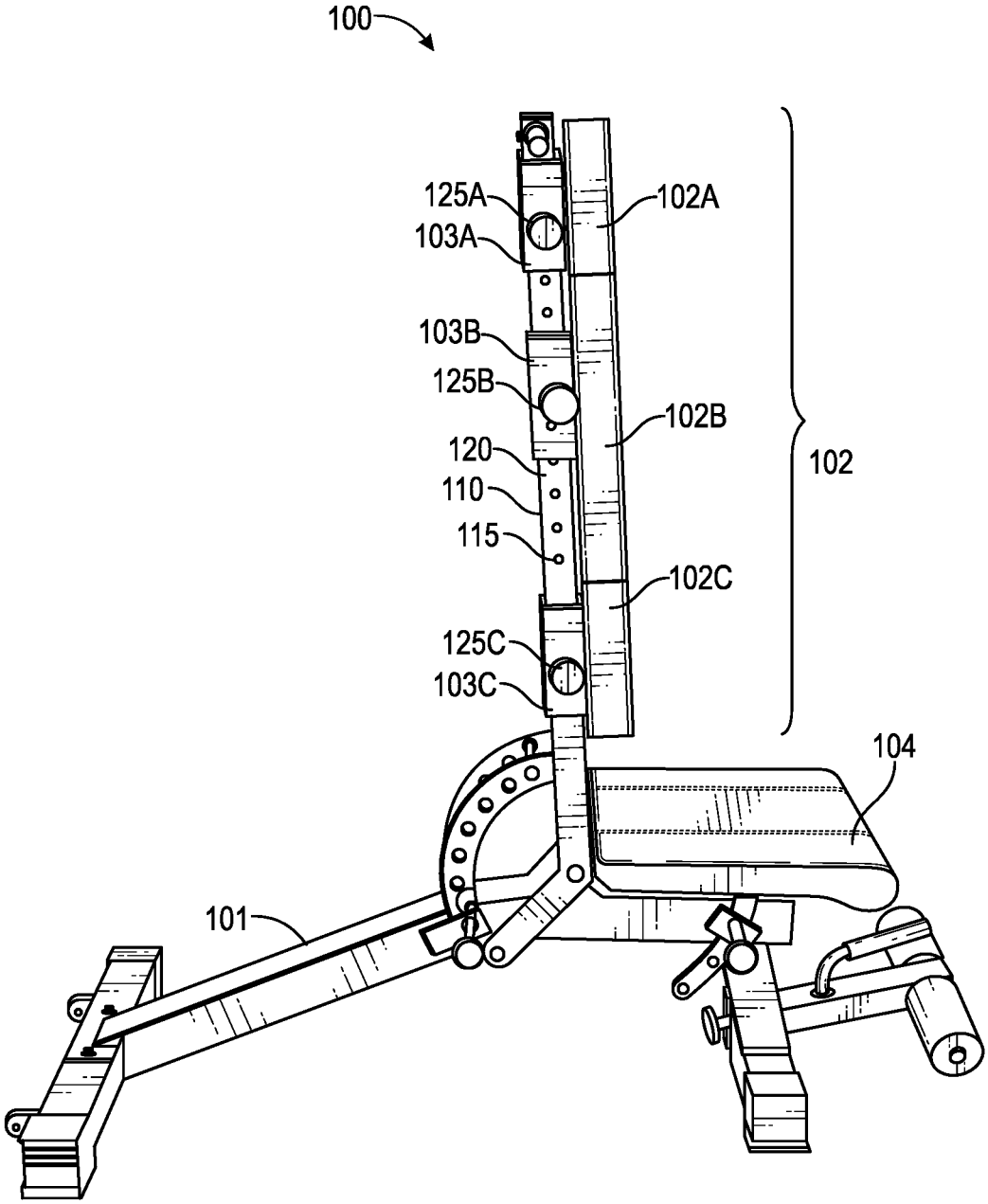
FIG. 1A illustrates an exercise bench in accordance with an embodiment.
Figure 1B:
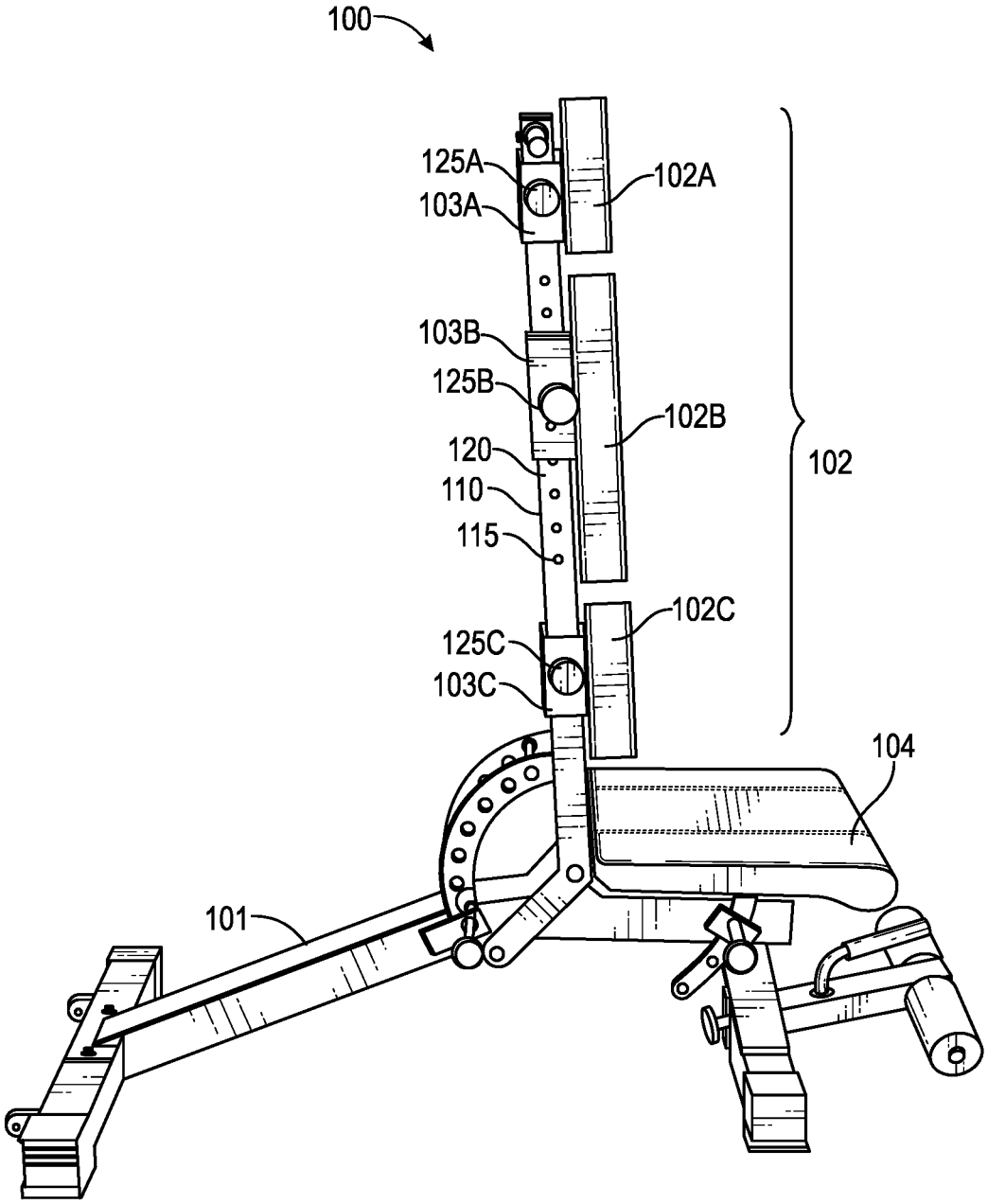
FIG. 1B illustrates an exercise bench in accordance with an embodiment.

FIGS. 1A-1B illustrate an exercise bench 100 in accordance with an embodiment. As shown, the exercise bench 100 can include a basal frame 101. A seat 104 is attached to the basal frame 101. The seat 104 can include a pad. The height of the seat 104 can be adjusted (for example, moved between 0 degrees to 30 degrees) depending on a user's requirements. A mounting bar 120 can be coupled to the basal frame 101. The mounting bar 120 can include a central opening and a plurality of pre-drilled holes along a sidewall or opposing sets of holes/through holes 115 along at least two side surfaces/sidewalls.

A backrest assembly 102 can be integrated with or coupled to the basal frame 101. In an embodiment, the mounting bar 120 can be mounted vertically to the basal frame 101. The backrest assembly 102 further comprises a carriage assembly 110 (further described with reference to FIGS. 2A-2B, 3A-3B, and 4A-4B).

Conventional exercise benches have a one-piece backrest which is configured to support the user's back and head. The backrest of conventional adjustable benches can be inclined or reclined but the overall height of the backrest cannot be adjusted or changed based on the user's height. Advantageously, the backrest assembly 102 comprises multiple segments, for example, at least one headrest segment or piece/unit/part and one or more backrest segment or pieces/units/parts. For example, the backrest assembly 102 can include a headrest 102A and at least a first backrest segment 102B and a second backrest segment 102C. Each segment can be configured to be movable or adjustable to accommodate users having varying heights or for user comfort. For example, as shown in FIG. 1B, headrest 102A and backrest segments 102B-102C can be moved along a vertical plane, that is the headrest and backrest segments 102A-102C can be moved upward and downward along the mounting bar 120.

Figure 2A:
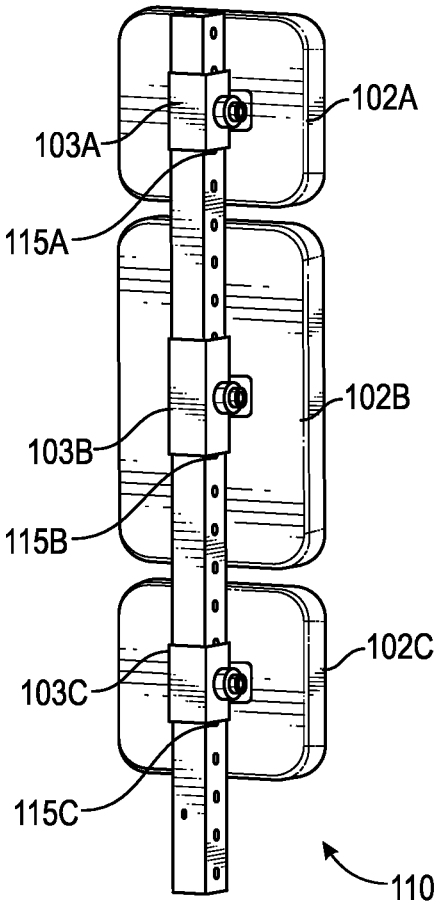
FIGS. 2A-2B illustrate a carriage assembly for the exercise bench in accordance with another embodiment.
Figure 2B:
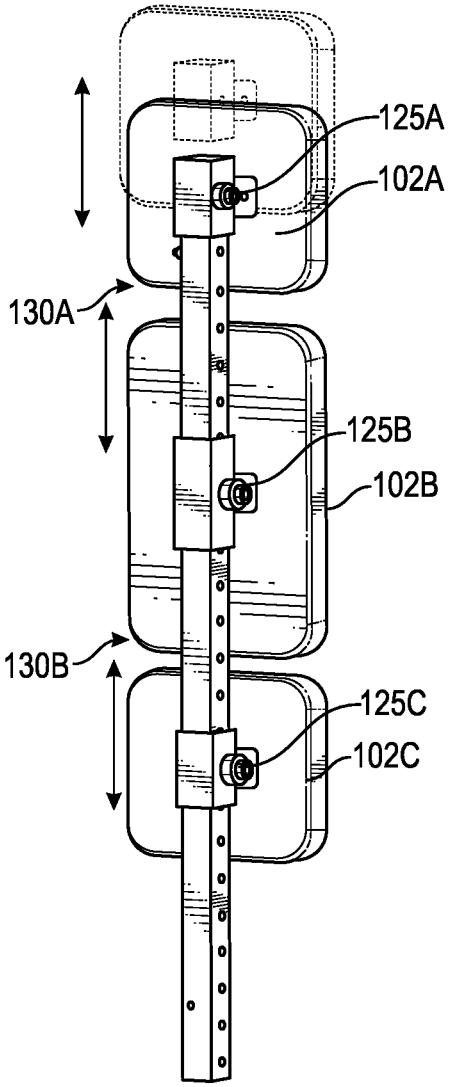

As shown in FIGS. 2A and 2B, the backrest assembly 102 can include multiple distinct segments 102A, 102B, 102C. For example, the backrest assembly 102 has a headrest 102A, a first backrest segment 102B and a second backrest segment 102C, wherein each segment is separated from the adjacent segment. The headrest segment 102A is designed to substantially support the head of the user while each backrest segment 102B, 102C are designed to substantially support a portion of the back of the user. The headrest segment 102A and the backrest segments 102B, 102C can each be moved upward or downward along the mounting bar 120 using corresponding carriage members 103A, 103B, and 103C (as shown in FIGS. 1A-1B and 2A). In an example, the second backrest segment 102C can be moved or slided toward or away from the seat 104. In one or more embodiments, the seat 104 can also be moved or slided toward or away from the second backrest segment 102C such that any gap between the second backrest segment 102C and the seat 104 is decreased or increased. It is understood that the shape and other dimensions, such as, the height and width, of the multiple segments 102A, 102B, and 102C can be changed/varied and all such variations are within the scope of the invention.

Each adjacent surface of the multiple segments 102A, 102B, 102C can be sized and shaped for a substantially close sliding reception. As shown in FIGS. 1B and 2B, the segments 102A-102C are capable of selective upward and downward movement along the mounting bar 120 when their corresponding carriage members 103A-103C are moved upward or downward by a user (not shown). In one or more embodiments, the carriage members described herein are tubular members having sidewalls and a central cavity.

The segments 102A, 102B, and 102C and seat 104 can be padded or have cushions. The pads/cushions can be made of any suitable material that is firm but also allows for a comfortable workout experience for the user.

It is understood that the segments 102A, 102B, and 102C can have any suitable shape and size. Furthermore, in one or more embodiments (not shown), an additional component (not shown) can be used in between the headrest and the backrest segments (and between the lowermost backrest segment and the seat) to ensure a smoother profile when the segments are moved closer to each other.

FIGS. 2A-2B illustrate a carriage assembly 110 for the exercise bench 100 in accordance with an embodiment. The carriage assembly 110 can include carriage members 103A, 103B, 103C affixed or otherwise coupled to a back surface of the headrest 102A and backrest segments 102B, 102C. In an example, the carriage assembly 110 can have a first carriage member 103A coupled to a back surface of the headrest 102A, a second carriage member 103B coupled to a back surface of the first backrest segment 102B, and a third carriage member 103C coupled to a back surface of the second backrest segment 102C. Each carriage member 103A-103C includes a central opening. The mounting bar 120 can be inserted through the central opening of each of the carriage members. The carriage members 103A, 103B, 103C are made of a suitable durable and sturdy material, such as, steel or other suitable materials. The carriage members 103A, 103B, 103C can be substantially tubular, square or rectangular-shaped members. In one example, the carriage members 103A-103C can be brackets. As mentioned earlier, each carriage member can include one or more sets of holes (not shown). The holes on the carriage member are designed to receive a corresponding connector 125A-125C.

The mounting bar 120 can be cylindrical, columnar or cuboid. The mounting bar 120 can include a plurality of pre-drilled sets of holes 115 drilled along its sidewalls. In one or more embodiments, the holes 115 can be through holes so the brackets can be reversed and accessible from either side of the mounting bar 120. Each set of holes 115 can be spaced apart substantially equidistant from an adjacent set of holes. In an embodiment, each set of holes 115 may be optionally separated by one inch or one-half inch from an adjacent set of holes.

Each carriage member 103A, 103B, 103C has at least one opening (not shown) on a sidewall or a set of opposing openings/holes on opposing sidewalls for receiving a connector. For example, the first carriage member 103A has an opening or a set of openings for receiving a first connector 125A, the second carriage member 103B has an opening or a set of openings for receiving a second connector 125B, and the third carriage member 103C has an opening or a set of openings for receiving a third connector 125C. The connectors 125A, 125B, 125C are configured to fasten or lock the corresponding carriage members at a desired height/position on the mounting bar 120. The connectors 125A, 125B, 125C can include, without limitations, any conventional fastener, such as, a screw, bolt, securing pin, pin pop-pins or removable pins known in the art. In one or more embodiments, other conventional securing means, such as clamps, can be used to lock the carriage members 103A, 103B, 103C in position at a desired height on the mounting bar 120.

The connectors 125A, 125B, 125C can also include a rotatable knob. When the connectors are loosened by rotating them in a first direction (for example, a clockwise direction), the carriage members 103A, 103B, 103C can be moved up or down the mounting bar 120. The carriage members can be locked in position at a desired height by rotating the connectors 125A, 125B, 125C in a second direction (for example, a counterclockwise direction). Depending on the user's requirements, each carriage member can be moved up or down the mounting bar 120 and secured within a hole 115 at a desired height independently. In another embodiment, the connectors are configured without a rotatable knob. In this and other embodiments, the connectors can secure the carriage members in position at a desired height without an additional locking or securing mechanism.

Figure 3A:
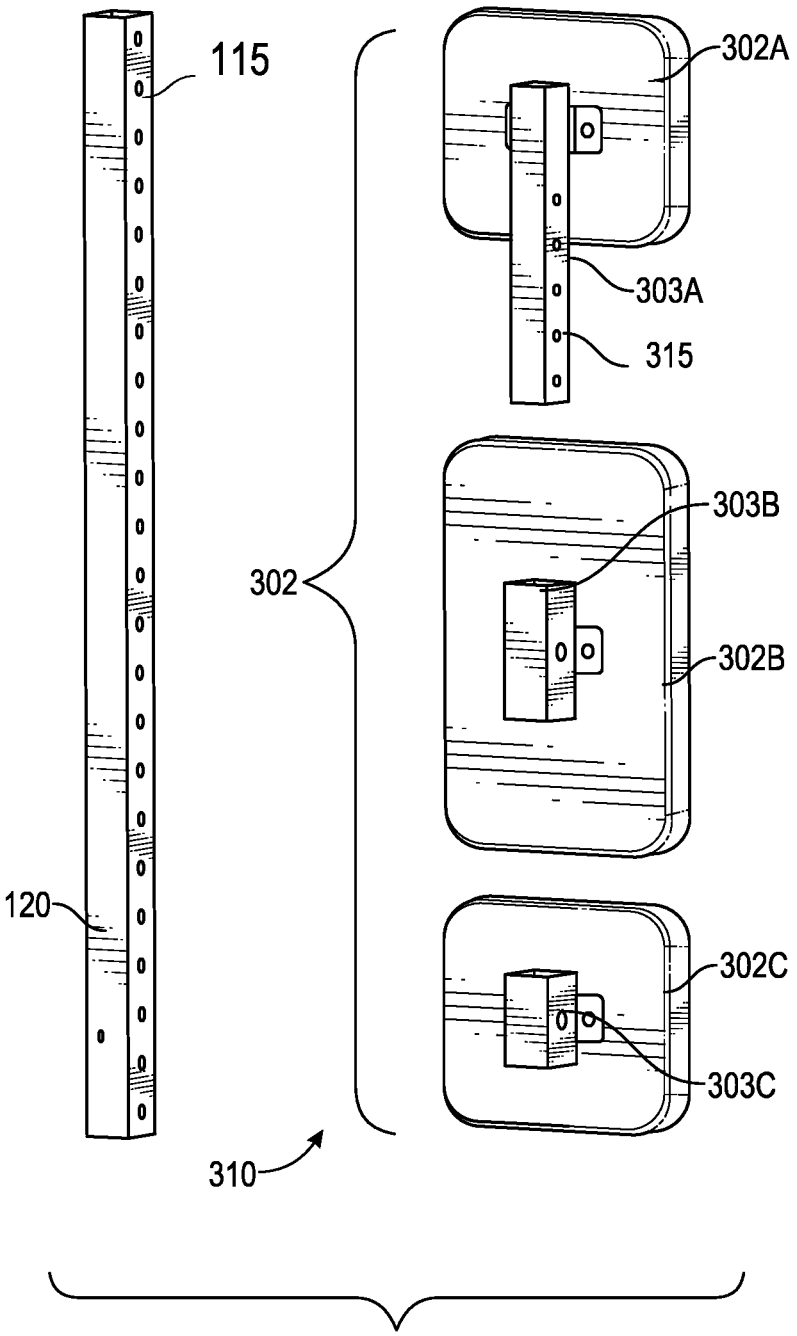
FIGS. 3A-3B illustrate a carriage assembly for an exercise bench in accordance with another embodiment.
Figure 3B:
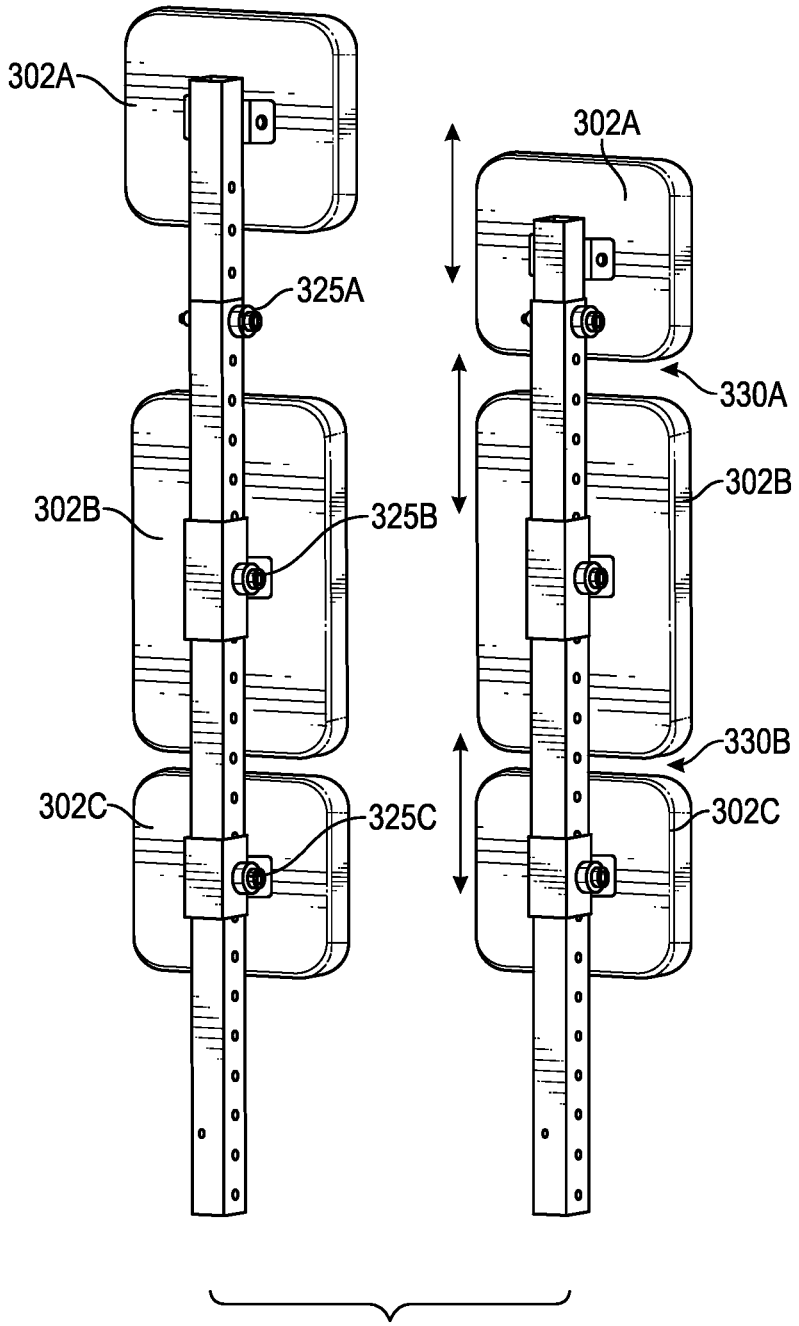

As shown in FIGS. 2A-2B and 3B, the headrest segment 102A and the first backrest segment 102B can be moved such that there is a first space or gap 130A between the two pads. Similarly, the first backrest segment 102B and the second backrest segment 102C can be moved such that there is a second space or gap 130B between the two segments.

In use, the user can move the headrest 102A upward (or downward) by loosening the first connector 125A coupling the first carriage member 103A to the mounting bar 120. For example, the first connector can be rotated in a first direction to loosen it. After the headrest is loosened, it can be moved to a desired height and one or a set of holes/openings (not shown) in the first carriage member 103A is aligned with a corresponding hole or set of holes 115A in the mounting bar 120, and the connector 125A is inserted through the aligned holes. The first connector 125A can tightly secure the first carriage member 103A to the mounting bar 120 (for instance, by rotating the first connector in a second direction). In this manner, the headrest 102A is substantially immovably secured to the mounting bar. Similarly, the backrest segments 102B, 102C can be moved upward or downward and secured in position using a second and third connector 125B and 125C respectively. The second and third carriage members 103B and 103C can be aligned with corresponding holes or set of holes 115B and 115C in the mounting bar 120 respectively.

As needed, the headrest and backrest segments 102A-102C can also be moved close to each other such that the bottom surface of the headrest 102A contacts or abuts an upper surface of the first backrest segment 102B and the bottom surface of the first backrest segment 102B contacts or abuts an upper surface of the second backrest segment 102C to form a substantially mated backrest/headrest combination unit. Thus, the user of the exercise bench 100 can adjust the height(s) of the headrest and/or backrest segments to fit their own height or exercise requirements. The headrest segment 102A and the backrest segments 102B, 102C can further facilitate safety, comfort and proper form as the user can adjust their body into a position allowing for stability (such as, feet flat on the floor and/or head not hanging off the end of the bench).

The exercise bench 100 can further include a mechanism for inclining or declining the headrest and segmented backrest. Any conventional mechanism known in the art can be used for inclining/declining the headrest and backrest.

It is understood that the headrest segment 102A, first backrest segment 102B, and second backrest segment 102C are configured for independent upward and downward slidable movement along the mounting bar 120. As such, each segment can move independently or be stationary depending on the desired positions of the segments.

FIGS. 3A-3B and 4A-4B illustrate a carriage assembly 310, 410 for an exercise bench in accordance with another embodiment. The backrest assemblies 302 and 402 have carriage members 303A, 403A. The carriage members 303A, 403A can be attached to or otherwise coupled to a back surface of a headrests 302A, 402A along a first end. Unlike the first carriage member 103A, a second end of the carriage members 303A and 403A can be configured for slidable insertion inside or within a hollow cavity in the mounting bar 120 (as opposed to the mounting bar being inserted within an opening in the carriage member). The carriage members 303A, 403A can then be connected securely to the mounting bar using connectors 325A, 425A. Advantageously, by adjusting the height of the carriage member 303A, 403A (that is, by moving the carriage members 303A, 403A upward or within the mounting bar 120, as required), the user can adjust the height of the headrests 302A, 402A by itself without having to make any corresponding adjustments to the heights of the backrest segments 302B, 302C or unsegmented backrest 402B. Additionally, this arrangement also provides the user the option to extend the height of the headrest up to several inches beyond the height of the mounting bar 120. Once the headrests 302A, 402A are moved to a desired height, the user can securely couple the carriage members 303A, 403A to the mounting bar 120 using connectors 325A, 425A.

The carriage members 303A, 403A can be dimensioned to slide within or fitted inside the mounting bar 120. The carriage members 303A, 403A can be cylindrical, columnar or cuboid. The width and depth of the carriage members 303A, 403A can be smaller than the width and depth of the mounting bar 120.

Now referring back to FIGS. 3A-3B, the backrest assembly 302 also has a segmented backrest. As shown, the backrest 302 can include at least two slidable backrest segments 302B, 302C. The back surface of the backrest 302B can be coupled to a second carriage member 303B using connector 325B while a back surface of the second backrest segment 302C can be coupled to a third carriage member 303C. In one or more embodiments, the carriage member 303A is longer than the second and third carriage members 303B, 303C.

The first carriage member 303A can include a plurality of pre-drilled holes/openings or sets of holes 315 drilled along its sidewalls. In one or more embodiments, the openings 315 can be through holes so the brackets can be reversed and accessible from either side of the first carriage member 303A. Each opening 315 can be spaced apart substantially equidistant from an adjacent hole. In an embodiment, each opening 315 may be separated by one inch or one-half inch from an adjacent through hole. However, each of the openings need not be spaced apart at a substantially equal distance from an adjacent opening.

The headrest 302A and the first backrest segment 302B can be moved such that there is a first space or gap 330A between the two pads. Similarly, the first backrest segment 302B and the second backrest segment 302C can be moved such that there is a second space or gap 330B between the two segments.

All other features of this embodiment are similar to those disclosed earlier with reference to FIGS. 1A-2B, and not repeated for brevity.

The mounting bar 120 is configured to be securely mounted within a central opening in the second carriage member 303B and the third carriage member 303C. A second and third connector 325B, 325C can be used to secure the mounting bar to the second and third carriage members 303B, 303C respectively. The height of the backrest segments 302B, 302C can be adjusted by removing the corresponding connectors 325B, 325C from the mounting bar 120, moving these segments to a desired height and then tightening the corresponding connectors.

Similarly to the embodiment discussed in reference to FIGS. 1A and 1B, each adjacent surface of the multiple segments 302A, 302B, 302C are sized and shaped for a substantially close sliding reception. The user (not shown) can move the headrest segment 302A and backrest segments 302B, 302C close together, as needed, such that the bottom of the adjacent surface of the headrest segment 302A contacts or abuts the surface of the first backrest segment 302B to form a substantially joined backrest assembly 302.

Figure 4A:
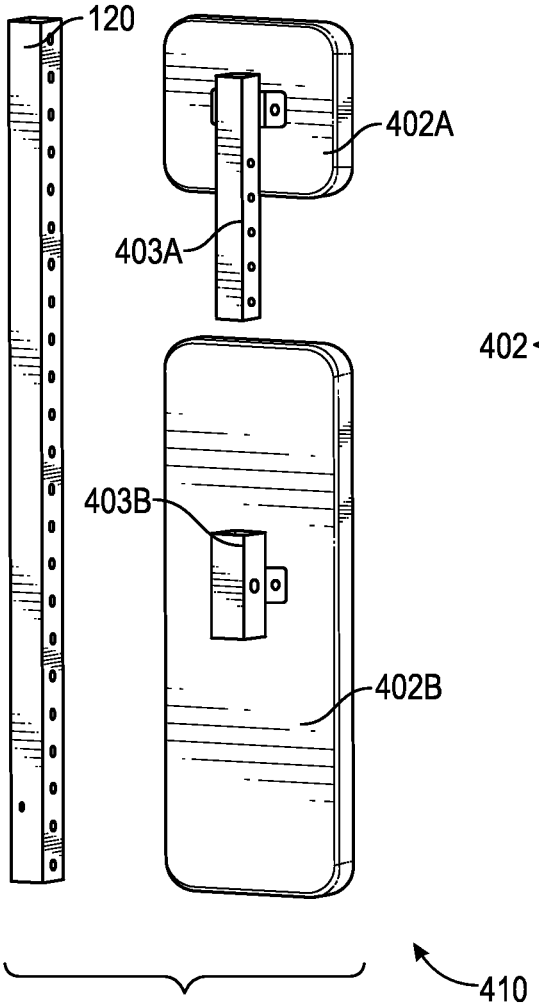
FIGS. 4A-4B illustrate a carriage assembly for the exercise bench in accordance with another embodiment.
Figure 4B:
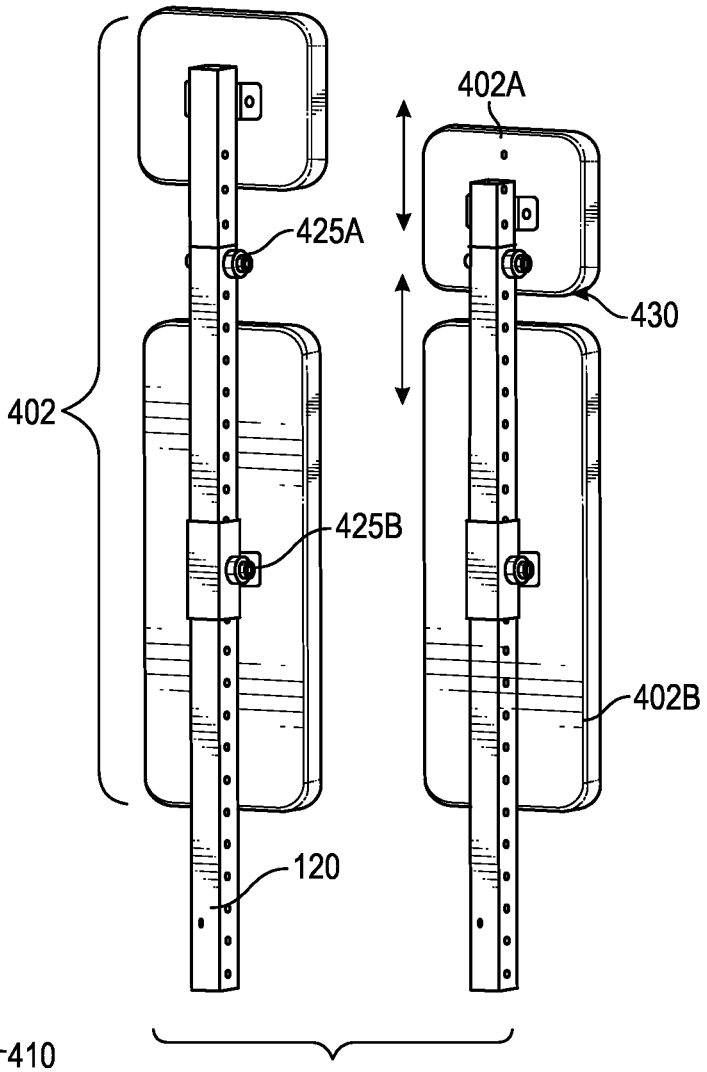

In another embodiment, shown in FIGS. 4A-4B, the backrest is unsegmented 402B. Similar to the embodiment described under FIGS. 3A-3B, the headrest segment 402A has a carriage member 403A that is configured for insertion into the mounting bar 120. The carriage member 403A can be dimensioned to fit within the mounting bar 120.

The back surface of the unsegmented backrest 402B can be coupled to a second carriage member 403B using connector 425B. The headrest 402A and the unsegmented backrest 402B can be moved such that there is a space or gap 430 between the two pads.

The exercise bench according to one or more embodiments is adjustable, wherein the headrest and backrest (including two or more segments of the backrest) are all configured to be movable or adjustable in a vertical plane, that is, they can be moved upward and downward.

In one or more embodiments, the carriage members may be motorized for convenience.

While the foregoing describes various embodiments of the invention, other and further embodiments of the invention may be devised without departing from the basic scope thereof. The scope of the invention is determined by the claims that follow. The invention is not limited to the described embodiments, versions, or examples, which are included to enable a person having ordinary skill in the art to make and use the invention when combined with information and knowledge available to the person having ordinary skill in the art.

The invention claimed is:

1. A backrest assembly for an exercise bench, comprising:
- a mounting bar;
- a first carriage member, wherein at least one end of the first carriage member is dimensioned for insertion within a hollow cavity in the mounting bar;
- a headrest, wherein a back surface of the headrest is coupled to the first carriage member; and
- a backrest configured for upward and downward movement along the mounting bar;
- a second carriage member, wherein a back surface of the backrest is coupled to the second carriage member; and
- wherein the mounting bar is configured to be securely mounted in a central opening in the second carriage member.

2. The backrest assembly according to claim 1, wherein the headrest is configured for upward and downward movement as the first carriage member is correspondingly retracted from and inserted within the hollow cavity in the mounting bar.

3. The backrest assembly according to claim 1, further comprising securing the mounting bar to the first carriage member with a first connector.

4. The backrest assembly according to claim 1, wherein the headrest and backrest are padded.

5. The backrest assembly according to claim 1, wherein the backrest comprises one or more segments.

6. The backrest assembly according to claim 1, wherein the backrest comprises two or more segments.

7. The backrest assembly according to claim 6, wherein a back surface of a first backrest segment is coupled to the second carriage member.

8. The backrest assembly according to claim 7, wherein a back surface of a second backrest segment is coupled to a third carriage member.

9. The backrest assembly according to claim 8, wherein the mounting bar is configured to be securely mounted in a central opening in the third carriage member.

10. The backrest assembly according to claim 9, further comprising securing the mounting bar to the second and third carriage members with a second and third connector respectively.

11. The backrest assembly according to claim 10, wherein the first and/or second backrest segment is configured for upward and downward movement along the mounting bar.

12. The backrest assembly according to claim 1, wherein the mounting bar is coupled to a basal frame.

13. The backrest assembly according to claim 1, wherein basal frame comprises a seat.

* * * * *